US008820975B2

(12) United States Patent
Lee

(10) Patent No.: US 8,820,975 B2
(45) Date of Patent: Sep. 2, 2014

(54) LED LIGHTING DEVICE AND STREETLIGHT DEVICE HAVING SAME

(71) Applicant: Icepipe Corporation, Seoul (KR)

(72) Inventor: Sang-Cheol Lee, Gyeonggi-do (KR)

(73) Assignee: Icepipe Corporation, Seoul (KR)

( * ) Notice: Subject to any disclaimer, the term of this patent is extended or adjusted under 35 U.S.C. 154(b) by 0 days.

(21) Appl. No.: 13/660,806

(22) Filed: Oct. 25, 2012

(65) Prior Publication Data

US 2013/0051038 A1 Feb. 28, 2013

Related U.S. Application Data

(63) Continuation of application No. PCT/KR2011/004827, filed on Jul. 1, 2011.

(30) Foreign Application Priority Data

Sep. 6, 2010 (KR) ..... 10-2010-0087004

(51) Int. Cl.

| | |
|---|---|
| ***F21V 29/00*** | (2006.01) |
| ***F21S 4/00*** | (2006.01) |
| *F21V 3/00* | (2006.01) |
| *F21V 15/01* | (2006.01) |
| *F21W 131/103* | (2006.01) |
| *F21S 8/08* | (2006.01) |
| *F21Y 101/02* | (2006.01) |

(52) U.S. Cl.

CPC ..... *F21V 29/006* (2013.01); *F21V 3/005* (2013.01); *F21V 15/011* (2013.01); *F21W 2131/103* (2013.01); *F21V 29/2293* (2013.01); *F21S 8/086* (2013.01); *F21V 29/2275* (2013.01); *F21V 29/004* (2013.01); *F21Y 2101/02* (2013.01)

USPC ..... 362/294; 362/249.02; 362/373; 362/431

(58) Field of Classification Search

USPC ..... 362/249.02, 373, 294, 431

See application file for complete search history.

(56) References Cited

U.S. PATENT DOCUMENTS

| | | | | |
|---|---|---|---|---|
| 6,315,033 | B1 | 11/2001 | Li | |
| 2008/0094798 | A1 | 4/2008 | Lee et al. | |
| 2008/0117637 | A1 | 5/2008 | Chang et al. | |
| 2010/0141108 | A1* | 6/2010 | Liu et al. | 313/12 |
| 2010/0212865 | A1 | 8/2010 | Lee | |
| 2011/0305025 | A1* | 12/2011 | Loveland | 362/294 |

FOREIGN PATENT DOCUMENTS

| | | | |
|---|---|---|---|
| EP | 2119961 | A1 | 11/2009 |
| JP | 1992023456 | A | 1/1992 |
| JP | 2008243780 | A | 10/2008 |
| KR | 1020090126735 | A | 12/2009 |
| KR | 1020100040104 | A | 4/2010 |
| KR | 20100056615 | A | 5/2010 |
| KR | 20100056715 | A | 5/2010 |
| KR | 20100063988 | A | 6/2010 |
| KR | 1020100084236 | A | 7/2010 |

OTHER PUBLICATIONS

"International Preliminary Report on Patentability", International Preliminary Report on Patentability with Written Opinion issued Mar. 12, 2013, received in corresponding PCT Application No. PCT/KR2011/004827, 5 pgs.

"International Search Report", International Search Report mailed Nov. 23, 2011, received in corresponding PCT Application No. PCT/KR2011/004827, 2 pgs.

Japanese Office Action issued Aug. 27, 2013, received in related Japanese Application No. 2013-506096, with English language summary, 34 pgs.

European Search Report mailed Apr. 3, 2014, received in related EP Application No. 11823713.0, 10 pgs.

* cited by examiner

*Primary Examiner* — Sean Gramling

(74) *Attorney, Agent, or Firm* — Grossman Tucker Perreault & Pfleger, PLLC

(57) ABSTRACT

An LED lighting device includes: an LED module; a thermal base coupled with the LED module and configured to absorb heat; and a heat-pipe loop formed in a tubule shape and having working fluid injected thereinto and comprising a heat-absorption portion coupled with the thermal base and configured to absorb heat and a heat-dissipating portion configured to dissipate the heat absorbed by the heat-absorption portion, wherein each coil of the heat-pipe loop is formed in a thin and long shape, and one side of the thin-and-long coil is coupled to the thermal base, and the other side of the thin-and-long coil is protruded to an outside from an edge of the thermal base.

9 Claims, 6 Drawing Sheets

LED LIGHTING DEVICE AND STREETLIGHT DEVICE HAVING SAME

CROSS-REFERENCE TO RELATED APPLICATIONS

This application is a continuation of PCT/KR2011/004827 filed Jul. 1, 2011, which claims the benefit of Korean Patent Application No. 10-2010-0087004, filed with the Korean Intellectual Property Office on Sep. 6, 2010, the disclosure of which is incorporated herein by reference in its entirety.

TECHNICAL FIELD

The present relates to an LED lighting device and a streetlight device having the same.

BACKGROUND ART

An LED lighting device utilizing LED has a large amount of heat generated due to heat generated by the LED. Generally, when an electronic device is overheated, the electronic device may malfunction or be damaged, and thus it is essentially required to equip the LED lighting device with a heat-dissipating structure in order to prevent the overheating.

Disclosed previously as an example of a heat-dissipating device used for the LED lighting device has been a heat-dissipating device having heat-dissipating fins.

However, it is difficult for the heat-dissipating fin structure of heat-dissipating device to keep the surface areas of the heat-dissipating fins large enough when the size of a heat-absorption portion needs to be small due to the small size of an LED module. Moreover, even if the surface areas of the heat-dissipating fins are enlarged, there is quite a distance between the heat-absorption portion and a heat-dissipating portion, slowing the speed of heat transfer and keeping the heat-dissipating efficiency from improving.

Moreover, the heat-dissipating fin structure of heat-dissipating device needs to have a sufficient volume in order to secure a sufficient area of the heat-dissipating fins, making the LED lighting device thicker and making its storage, transportation and installation difficult.

Furthermore, the heat-dissipating fins are vulnerable to contamination, and thus the heat-dissipating performance is often deteriorated by contamination when installed outdoors.

DISCLOSURE

Technical Problem

The present invention provides a heat-dissipating device having a good heat-transfer performance and heat-dissipating efficiency and an LED lighting device having such a heat-dissipating device.

Moreover, the present invention provides an LED lighting device that can be installed at various locations and can be readily stored and transported.

Furthermore, the present invention provides an LED lighting device that can continuously maintain a heat-dissipating performance outdoors.

Technical Solution

An aspect of the present invention features an LED lighting device including: an LED module; a thermal base coupled with the LED module and configured to absorb heat; and a heat-pipe loop formed in a tubule shape and having working fluid injected thereinto and including a heat-absorption portion coupled with the thermal base and configured to absorb heat and a heat-dissipating portion configured to dissipate the heat absorbed by the heat-absorption portion. Each coil of the heat-pipe loop can be formed in a thin and long shape, and one side of the thin-and-long coil can be coupled to the thermal base, and the other side of the thin-and-long coil can be protruded to an outside from an edge of the thermal base.

A ratio between a width and a length of the thin-and-long coil can be between 1:5 and 1:200.

The heat-pipe loop can be radially disposed along the edge of the thermal base.

The thermal base can be formed in a plate shape, and the LED module can be coupled to one surface of the thermal base, and the thin-and-long coil can be aligned and arranged on the other surface of the thermal base, thereby constituting the LED lighting device in a thin structure.

One side of the thin-and-long coil can be overlapped with an opposite area of the LED module 10 on the other surface of the thermal base.

The LED lighting device can additionally include a cover member configured to cover the heat-pipe loop and having ventilation holes formed therein, respectively, on either side of the heat-pipe loop.

The ventilation holes on either side of the heat-pipe loop can be disposed in the cover member to face each other.

Another aspect of the present invention features a streetlight device including: the LED lighting device; and a support body configured to support the LED lighting device. The LED module can be disposed to face the ground, and an updraft generated by a difference in temperature between a front face and a rear face of the LED lighting device can pass the heat-pipe loop through the ventilation holes.

The cover member can include: a rear-face cover disposed on the rear face of the LED lighting device so as to cover the heat-pipe loop from sunlight; and a front-face cover disposed on the front face of the LED lighting device so as to cover the heat-pipe loop.

MODE FOR INVENTION

Hereinafter, an embodiment of the present invention will be described with reference to the accompanying drawings.

Figure 1:
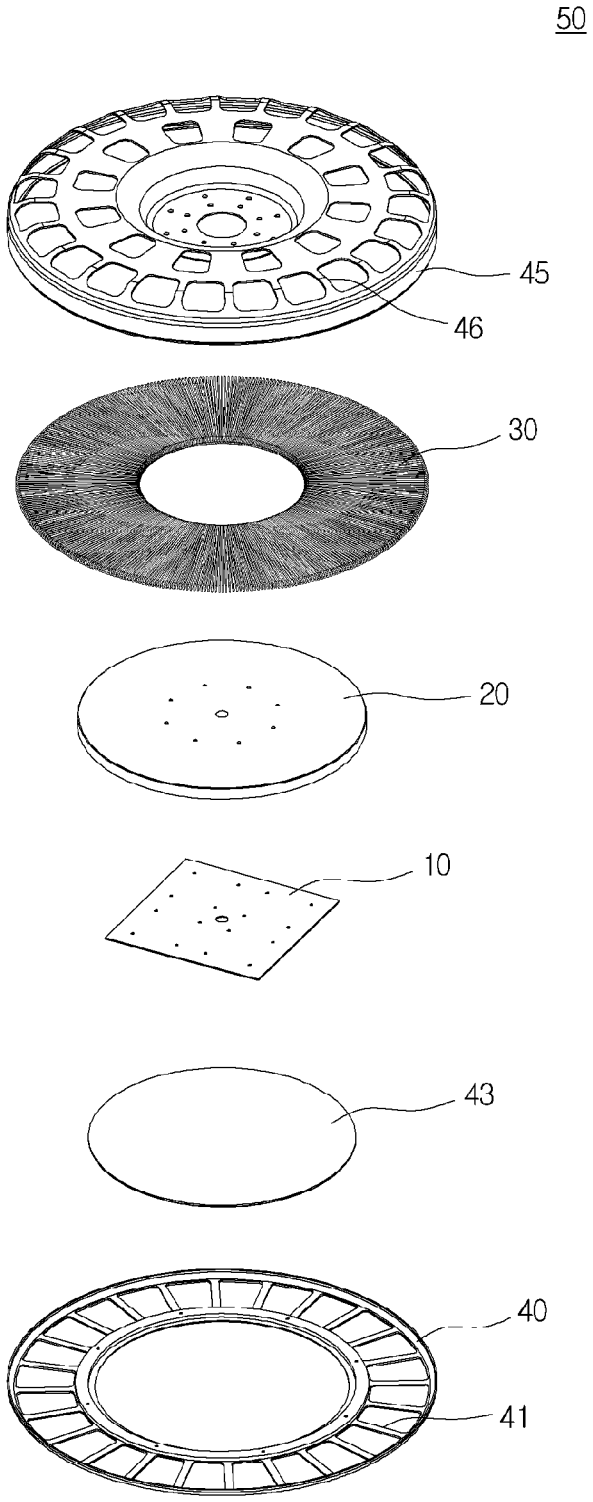
FIG. 1 is an exploded perspective view illustrating an LED lighting device in with an embodiment of the present invention.
Figure 2:
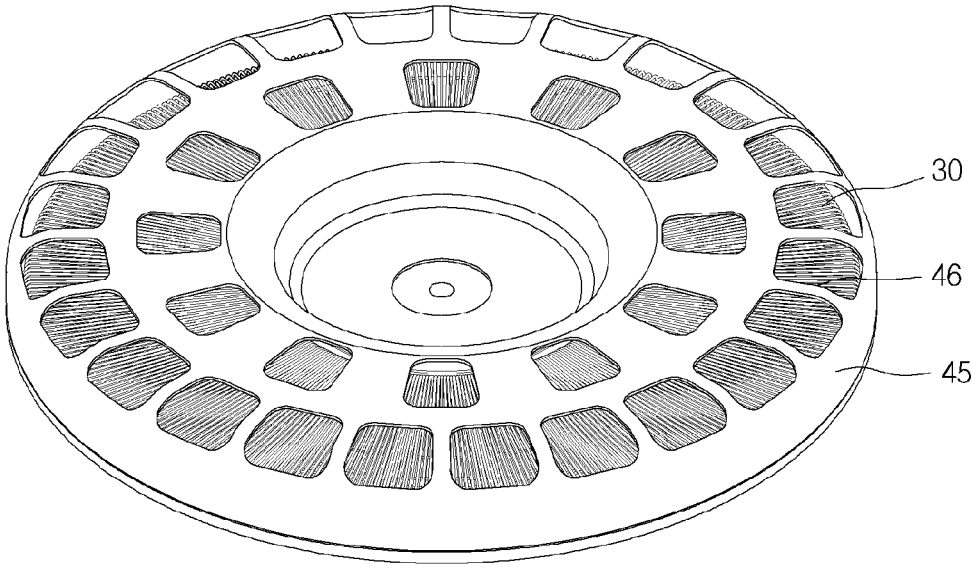
FIG. 2 is a perspective view illustrating the LED lighting device in accordance with an embodiment of the present invention.
Figure 3:
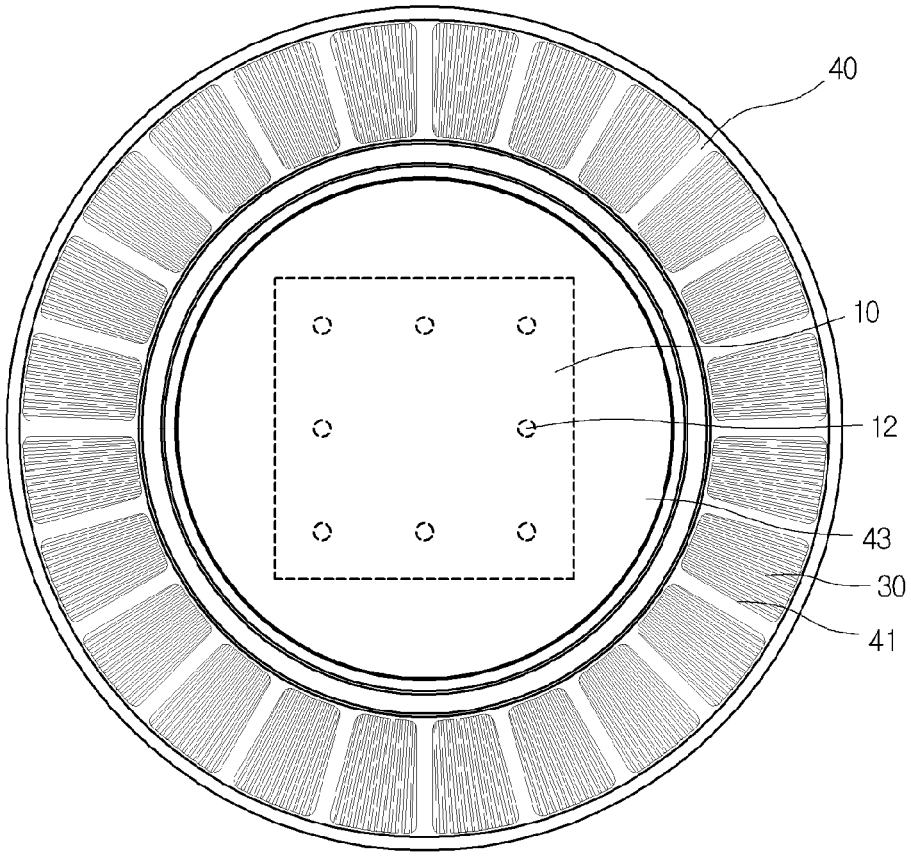
FIG. 3 is a bottom view illustrating the LED lighting device in accordance with an embodiment of the present invention.

FIG. 1 is an exploded perspective view illustrating an LED lighting device in accordance with an embodiment of the present invention, and FIG. 2 is a perspective view illustrating the LED lighting device in accordance with an embodiment of the present invention, and FIG. 3 is a bottom view illustrating the LED lighting device in accordance with an embodiment of the present invention.

An LED lighting device 50 in accordance with an embodiment of the present invention includes an LED module 10, a thermal base 20 and a heat-pipe loop 30. Particularly, in the LED lighting device of the present embodiment, as a coil of the heat-pipe loop 30 is formed in a thin and long shape, and the thin-and-long coil is formed to be protruded from the thermal base 20, the LED lighting device 50 can be thinner and have a good ventilation effect.

The LED module 10 encompasses an LED 12 that can emit light by using electric energy to generate light required for lighting.

As shown in FIG. 1 and FIG. 3, the LED module 10 of the present embodiment is constituted with the LED 12 and a substrate to which the LED 12 is mounted.

The thermal base 20 is a part that receives heat generated by the LED module 10 and transfers the heat to the heat-pipe loop 30, and also functions to support the LED module 10 and the heat-pipe loop 30. Here, for fast heat transfer, the thermal base 20 of the present embodiment is made of a material that has a high thermal conductivity. Specifically, the thermal base 20 of the present embodiment is made of a metal, such as copper, aluminum, etc., which has a high thermal conductivity.

Figure 4:
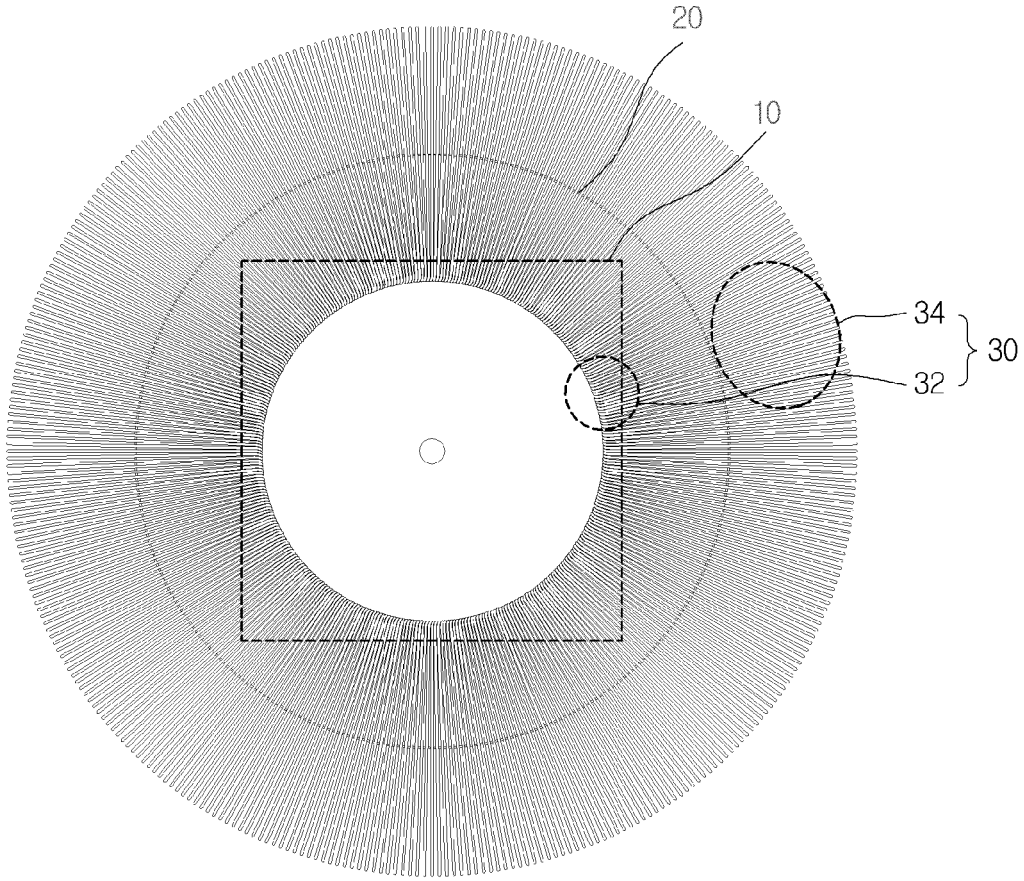
FIG. 4 and FIG. 5 illustrate the configuration of a heat-dissipating device in the LED lighting device in accordance with an embodiment of the present invention.
Figure 5:
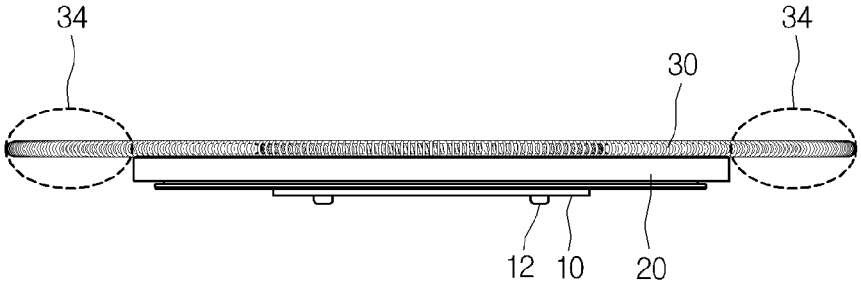

FIG. 4 and FIG. 5 illustrate the configuration of a heat-dissipating device in the LED lighting device in accordance with an embodiment of the present invention.

As shown in FIG. 4 and FIG. 5, the LED lighting device 50 of the present embodiment is constituted by being coupled with the thermal base 20 and the heat-pipe loop 30. Here, the thermal base 20 can be formed in a plate shape in order to make the LED lighting device 50 thinner.

The heat-pipe loop 30, which is a part that is coupled with the thermal base 20 and dissipates heat transferred through the thermal base 20, is constituted with a tubule type of heat pipe, into which working fluid is injected in order to quickly dissipate a large amount of heat, and includes a heat-absorption portion 32 and a heat-dissipating portion 34.

Particularly, in the heat-pipe loop 30 of the present embodiment, each coil constituting the heat-pipe loop 30 is formed in a thin and long shape, making it advantageous to form a thinner LED lighting device. Moreover, the heat-dissipating portion 34 of the thin-and-long coil has a structure that is protruded to an outside from an edge of the thermal base 20, thereby securing a high ventilation effect and maximizing heat-dissipation performance.

Firstly, the principle of heat transfer of the heat-pipe loop 30 in accordance with the present embodiment is as follows.

The working fluid is injected with air bubbles into the heat-pipe loop 30 of the present embodiment. Moreover, as shown in FIG. 4, the heat-absorption portion 32 absorbs heat by being thermally coupled with the thermal base 20 transferring the heat, and the heat-dissipating portion 34, which is linked with the heat-absorption portion 32, is separated from the thermal base 20 to dissipate the heat, which is transferred from the heat-absorption unit 32, to an outside.

In other words, the heat-pipe loop 30 of the present embodiment is constituted with a vibrating tubule type of heat pipe using hydrodynamics. The vibrating tubule type of heat pipe has a structure in which the working fluid and air bubbles are injected into the tubule in a predetermined ratio and then an inside of the tubule is sealed from an outside. Accordingly, the vibrating tubule type of heat pipe has a heat-transfer cycle in which the heat is mass transported in the form of latent heat by volume expansion and condensation of the air bubbles and working fluid. Moreover, the tubule-shaped heat pipe has a wide surface area even in a narrow space and thus has a high heat-dissipation performance.

In a specific heat-transfer mechanism, as nucleate boiling occurs in the heat-absorption portion 32 by as much as the absorbed amount of heat, volume expansion occurs in the air bubbles located in the heat-absorption portion 32. Here, since the tubule maintains a fixed internal volume, the air bubbles located in the heat-dissipating portion 34 condense by as much as the expanded volume of the air bubbles located in the heat-absorption portion 32. Accordingly, the state of pressure equilibrium in the tubule becomes broken, resulting in a flow accompanied with vibrations of the working fluid and the air bubbles within the tubule, and thus heat-dissipation is carried out as the latent heat is transported by the rise and fall of the temperature caused by the volume change of the air bubbles.

Here, the heat-pipe loop 30 can include the tubule made of a metal, such as copper, aluminum or iron, which has high thermal conductivity. Accordingly, the heat can be conducted quickly, and the volume change of the air bubbles injected into the heat-pipe loop 30 can be caused quickly.

Here, both an open loop and a close loop are possible for a communication structure of the heat-pipe loop 30. Moreover, if the heat-pipe loop 30 is provided in plurality, all or some of the plurality of heat-pipe loops 30 can be communicated with neighboring heat-pipe loops 30. Accordingly, the plurality of heat-pipe loops 30 can have an entirely open or close loop shape according to design requirement.

In the present embodiment, the heat-pipe loop 30 has an entirely-communicated close loop structure, and is formed in a spiral structure in which the heat-absorption portion 32 and the heat-dissipating portion 34 are repeatedly formed for easy manufacture.

Particularly, in the present embodiment, each coil constituting the heat-pipe loop 30 is formed in a thin and long shape so that the heat-pipe loop 30 can be thinner. That is, a cross section of a unit loop constituting the heat-pipe loop 30 is formed in the thin and long shape, which means that the length is greater than the width.

Upon a number of repeated tests, it is found to be preferable that the ratio between the width and the length of the thin-and-long coil formed into the tubule type of heat pipe is between 1:5 and 1:200. In the case that the ratio of the width of the coil of the heat-pipe loop 30 is greater than the above ratio, twisting and entanglement have often occurred among the coils in the heat-pipe loop 30 after manufacture, making it difficult to handle the coil. By contrast, in the case that the ratio of the length of the coil of the heat-pipe loop 30 is greater than the above ratio, manufacturing has been difficult.

As shown in FIG. 5, in the present embodiment, the LED module 10 is coupled to one surface of the plate-shaped thermal base 20, and the thin-and-long coil is aligned and arranged on the other surface of the thermal base 20, thereby constituting the LED lighting device 50 in a thin structure. The thin-structured LED lighting device 50 takes up a little space and is light and thus can be readily used for a ceiling light or a streetlight, for which an installation condition is limited, and can be readily transported and stored. However, the arrangement of the thin-and-long coil is not restricted to what is described in the present embodiment, and the thin-and-long coil can be also arranged at a certain angle with respect to the thermal base 20, if necessary. For example, it is possible to arrange the thin-and-ling coil in a lampshade form having the shape of letter "V" in such a manner that a diameter thereof becomes wider toward a surface to which the light is irradiated or having the shape of inverse letter "V" in such a manner that the diameter becomes narrower toward the surface to which the light is irradiated.

Here, as shown in FIG. 4, one side of the thin-and-long coil that functions as the heat-absorption portion 32 by being coupled with the thermal base 20 is overlapped with an opposite area of the LED module 10 on the other surface of the thermal base 20, shortening a heat-transfer pathway to the heat-dissipating portion 34 and improving the heat-dissipation performance further.

Moreover, in the heat-pipe loop 30 of the present embodiment, the heat-dissipating portion 34 of the heat-pipe loop 30 is formed in the shape that is protruded from the thermal base 20, in order to provide for a good air ventilation effect required for securing the heat-dissipation performance. For this, the one side of the thin-and-long coil that functions as the heat-absorption portion 32 of the heat-pipe loop 30 is coupled with the thermal base 20, and the other side of the thin-and-long coil that functions as the heat-dissipating portion 34 of the heat-pipe loop 30 is formed to be protruded to the outside in the edge of the thermal base 20. Accordingly, good, continuous air ventilation can be secured in the heat-dissipating portion 34 of the heat pipe.

A difference in temperature occurs around the LED module 10 due to the heat generated by the LED module 10, and thus air flow caused by the difference in temperature continuously occurs around the edge of the thermal base 20 that supports the LED module 10. In the meantime, it is important that new air continuously passes through the heat-dissipating portion 34 in order to dissipate the heat quickly from the heat-pipe loop 30.

Therefore, in the present embodiment, the other side of the thin-and-long coil, which is the heat-dissipating portion 34 of the heat-pipe loop 30, is protruded around the edge of the thermal base 20 in which the air flow occurs continuously, thereby securing good air ventilation in the heat-dissipating portion 34 and providing for the heat-dissipation performance.

Particularly, the air ventilation effect can be maximized when the LED lighting device of the present embodiment is used as a streetlight device.

Figure 6:
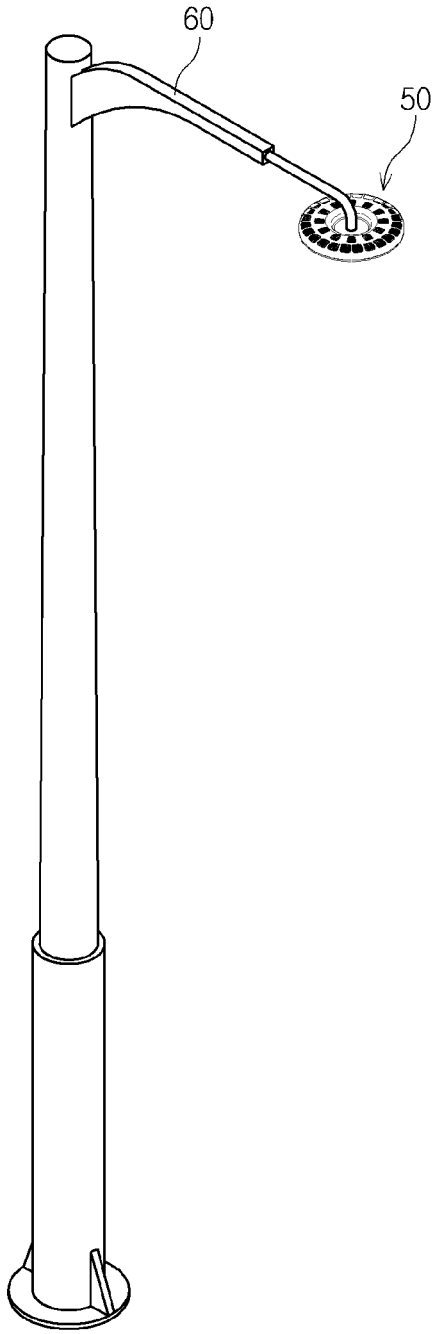
FIG. 6 is a perspective view illustrating a streetlight device having the LED lighting device in accordance with an embodiment of the present invention.
Figure 7:
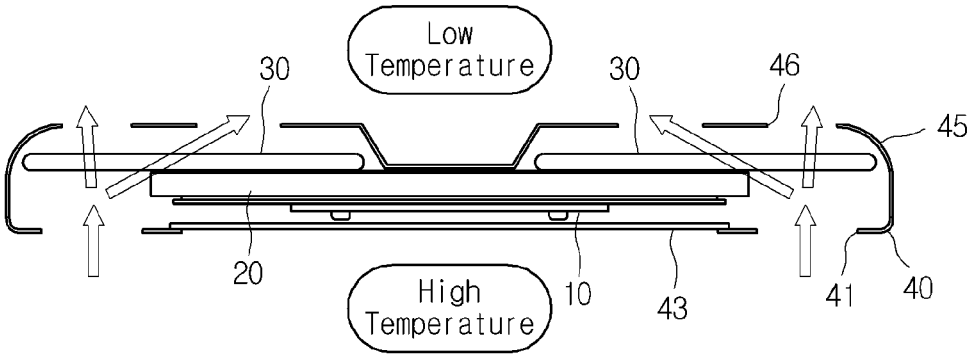
FIG. 7 illustrates a heat-dissipating mechanism in the streetlight device having the LED lighting device in accordance with an embodiment of the present invention.

FIG. 6 is a perspective view illustrating a streetlight device having the LED lighting device in accordance with an embodiment of the present invention, and FIG. 7 illustrates a heat-dissipating mechanism in the streetlight device having the LED lighting device in accordance with an embodiment of the present invention.

As shown in FIG. 6, in the case that the LED lighting device 50 of the present embodiment is used as a streetlight device, the LED lighting device 50 is supported by a support body 60, such as a post, so that the LED module 10 is arranged to face the ground.

In such a case, as shown in FIG. 7, the air adjacent to a front face of the LED lighting device 50 from which the light of the LED lighting device 50 is irradiated has the temperature thereof risen by the heat generated by the LED module 10. Accordingly, a difference in temperature occurs in the air between the front face and a rear face of the LED lighting device 50, and the air at the front face of the LED lighting device 50 that is relatively hotter but placed below becomes ascended to form an updraft. Then, the air flowing upward inevitably passes through the other side of the thin-and-long coil protruded in the edge of the thermal base 20, that is, the heat-dissipating portion 34 of the heat-pipe loop 30. Therefore, air flow is always formed in the heat-dissipating portion 34 of the LED lighting device 50 that is used as a streetlight device, providing for a high air ventilation effect and thus maximizing the heat-dissipation performance.

Here, the heat-pipe loop 30 can be radially arranged along the edge of the thermal base 20. As shown in FIG. 4, in the radially-arranged heat-pipe loop 30, the heat-dissipating portion 34 can occupy a relatively larger space than the heat-absorption portion 32, and thus the heat-dissipation performance can be further enhanced by the improved air ventilation effect of the heat-dissipating portion 34.

The LED lighting device 50 of the present embodiment can additionally include a cover member for covering the heat-pipe loop 30 in order to protect the heat-pipe loop 30 from an outside. Here, the cover member can have a perforated ventilation hole 46 formed therein so as not to restrict the air ventilation effect.

As shown in FIG. 7, the cover member of the present embodiment is constituted with a front-face cover 40, which is disposed on the front face of the LED lighting device to cover the heat-pipe loop 30 and support a transparent window 43, and a rear-face cover 45, which is disposed on the rear face of the LED lighting device 50 to cover the heat-pipe loop 30. In addition, the front-face cover 40 and the rear-face cover 45, which are respectively disposed on either side of the heat-pipe loop 30, have the ventilation hole 46 formed therein. Here, the ventilation holes 46 on either side of the heat-pipe loop 30 can be disposed to face each other so as to facilitate the air flow.

Moreover, the ventilation hole 46 of the present embodiment can also function as a washer port. In order to maintain the heat-dissipation performance of the heat-pipe loop 30 continuously, the heat-pipe loop 30 that has been contaminated by dirt and the like needs to be regularly washed. In the present embodiment, since the heat-pipe loop 30 can be accessed through the ventilation hole 46, the heat-pipe loop 30 can be readily washed, without removing the cover member, by injecting washer fluid, such as water, into the ventilation hole 46. Particularly, in the case that the LED lighting device 40 of the present embodiment is used for the streetlight device, the heat-pipe loop 30 can be washed naturally because rainwater can be flowed in through the ventilation hole 46 when it rains.

Furthermore, the rear face of the cover member can also function as a sunshade that covers the heat-pipe loop 30 from the sunbeam. As shown in FIG. 6, the rear-face cover 45 of the present embodiment forms a shade over the heat-pipe loop 30 when the sun shines. Accordingly, by minimizing an area of the heat-pipe loop being exposed to direct sunlight, it is possible to prevent the heat-dissipation performance from deterioration due to unnecessary heating of the working fluid within the heat-pipe loop 30 or excessive oxidization of the heat-pipe loop 30.

While the present invention has been described with reference to certain embodiment, the embodiment is for illustrative purposes only and shall not limit the invention. It is to be appreciated that those skilled in the art can change or modify the embodiment without departing from the scope and spirit of the invention.

It shall be also appreciated that a very large number of embodiments other than that described herein are possible within the scope of the present invention, which shall be defined by the claims appended below.

INDUSTRIAL APPLICABILITY

According to the present invention, the LED lighting device can be made thinner despite a wide heat-dissipation area and high heat-dissipation performance, and thus can be installed with little limitations and readily stored and transported.

Moreover, since a good air ventilation effect can be realized using air flow, the heat-dissipation performance of the LED lighting device can be maximized.

Furthermore, it is possible to prevent the heat-dissipation performance of the LED lighting device from being deteriorated by external environmental factors, such as sunlight and dirt.

The invention claimed is:

1. An LED lighting device comprising:

an LED module;

a thermal base coupled with the LED module and configured to absorb heat, wherein the thermal base is formed in a flat plate shape; and a heat-pipe loop formed in a tubule shape and having working fluid injected thereinto and comprising a heat-absorption portion coupled with the thermal base and configured to absorb heat and a heat-dissipating portion configured to dissipate the heat absorbed by the heat-absorption portion, wherein the heat-pipe loop has a plurality of coils and the plurality of coils are radially disposed along the edge of the thermal base, wherein the heat-pipe loop is formed in a spiral structure and each coil of the heat-pipe loop is formed in a thin and long shape such that each coil of the heat-pipe loop has a length greater than a width, and one side of the thin-and-long coil is coupled to the thermal base, and the other side of the thin-and-long coil extends past an edge of the thermal base to an outside, and wherein the LED module is coupled to one surface of the thermal base, and the thin-and-long coil is aligned and arranged on the other surface of the thermal base such that a length direction of the thin-and-long coil is parallel to the other surface of the thermal base, thereby constituting the LED lighting device in a thin structure.

2. The LED lighting device of claim 1, wherein a ratio between a width and a length of the thin-and-long coil is between 1:5 and 1:200.

3. The LED lighting device of claim 1, wherein one side of the thin-and-long coil is overlapped with an opposite area of the LED module 10 on the other surface of the thermal base.

4. The LED lighting device of claim 1, further comprising a cover member configured to cover the heat-pipe loop and having ventilation holes formed therein, respectively, on either side of the heat-pipe loop.

5. The LED lighting device of claim 4, wherein the ventilation holes on either side of the heat-pipe loop are disposed in the cover member to face each other.

6. A streetlight device comprising:

the LED lighting device in accordance with claim 4; and a support body configured to support the LED lighting device, wherein the LED module is disposed to face the ground, and wherein an updraft generated by a difference in temperature between a front face and a rear face of the LED lighting device passes the heat-pipe loop through the ventilation holes.

7. The streetlight device of claim 6, wherein the cover member comprises:

a rear-face cover disposed on the rear face of the LED lighting device so as to cover the heat-pipe loop from sunlight; and a front-face cover disposed on the front face of the LED lighting device so as to cover the heat-pipe loop.

8. The LED lighting device of claim 2, further comprising a cover member configured to cover the heat-pipe loop and having ventilation holes formed therein, respectively, on either side of the heat-pipe loop.

9. The LED lighting device of claim 3, further comprising a cover member configured to cover the heat-pipe loop and having ventilation holes formed therein, respectively, on either side of the heat-pipe loop.

* * * * *